US007640989B2

(12) United States Patent
Williamson, Jr. et al.

(10) Patent No.: US 7,640,989 B2
(45) Date of Patent: Jan. 5, 2010

(54) ELECTRICALLY OPERATED WELL TOOLS

(75) Inventors: Jimmie R. Williamson, Jr., Carrollton, TX (US); James D. Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 178 days.

(21) Appl. No.: 11/469,269

(22) Filed: Aug. 31, 2006

(65) Prior Publication Data

US 2008/0053662 A1 Mar. 6, 2008

(51) Int. Cl.
*E21B 34/06* (2006.01)
*F16K 31/08* (2006.01)

(52) U.S. Cl. ..... 166/332.8; 166/66.5; 166/66.6; 166/373; 166/386; 251/129.18; 251/129.01

(58) Field of Classification Search ..... 166/381, 166/386, 66.5, 66.6, 66.7, 332.1, 332.8, 373; 251/129.01, 129.09, 129.1, 129.15, 129.18
See application file for complete search history.

(56) References Cited

U.S. PATENT DOCUMENTS

| | | | | |
|---|---|---|---|---|
| 2,703,532 | A | 3/1955 | Alexander | |
| 3,196,948 | A | 7/1965 | Dye | |
| 3,666,030 | A | 5/1972 | Bohn et al. | |
| 3,731,742 | A | 5/1973 | Sizer et al. | |
| 3,854,695 | A | 12/1974 | Baugh | |
| 4,058,166 | A | 11/1977 | Crickmer | |
| RE30,110 | E | 10/1979 | Huebsch et al. | |
| 4,191,248 | A | 3/1980 | Huebsch et al. | |
| 4,295,795 | A | 10/1981 | Gass et al. | |
| 4,407,329 | A | 10/1983 | Huebsch et al. | |
| 4,467,870 | A | 8/1984 | Langham | |
| 4,566,534 | A * | 1/1986 | Going, III | 166/66.7 |
| 4,579,177 | A | 4/1986 | Going | |
| 4,619,323 | A | 10/1986 | Gidley | |
| 4,649,993 | A | 3/1987 | Going | |

(Continued)

FOREIGN PATENT DOCUMENTS

| | | |
|---|---|---|
| EP | 0436214 | 12/1990 |

(Continued)

OTHER PUBLICATIONS

European Search Report issued for EP Patent Application No. 07253395 dated Nov. 15, 2007 (6 pages).

*Primary Examiner*—Kenneth Thompson
(74) *Attorney, Agent, or Firm*—Marlin R. Smith

(57) ABSTRACT

Electrically operated well tools. A well system includes a well tool positioned in a wellbore. The well tool includes an actuator and an operating member displaceable to operate the well tool. The actuator includes a series of longitudinally distributed electromagnets, in which current is controllable in a predetermined pattern to thereby variably control longitudinal displacement of the operating member. In another well system, the operating member is displaceable between opposite maximum limits of displacement to operate the well tool, and an electromagnet is operative to displace the operating member to at least one position between the opposite maximum limits of displacement. In a method of operating a well tool, the well tool is operated by controlling current in a series of longitudinally distributed electromagnets of an actuator in a predetermined pattern, thereby causing corresponding longitudinal displacement of an operating member.

25 Claims, 9 Drawing Sheets

U.S. PATENT DOCUMENTS

| | | | |
|---|---|---|---|
| 4,667,736 | A | 5/1987 | Rumbaugh et al. |
| 4,725,783 | A | 2/1988 | Miyairi et al. |
| 4,732,225 | A | 3/1988 | Jurgens et al. |
| 4,771,982 | A | 9/1988 | Bodine et al. |
| 4,793,379 | A | 12/1988 | Eidsmore |
| 4,796,708 | A | 1/1989 | Lembcke |
| 4,798,247 | A | 1/1989 | Deaton et al. |
| 4,886,114 | A | 12/1989 | Perkins et al. |
| 4,940,207 | A | 7/1990 | Katsuyama |
| 4,981,173 | A | 1/1991 | Perkins et al. |
| 5,039,061 | A | 8/1991 | Heard et al. |
| 5,070,595 | A | 12/1991 | Perkins et al. |
| 5,070,944 | A | 12/1991 | Hopper |
| 5,257,663 | A | 11/1993 | Pringle et al. |
| 5,291,947 | A | 3/1994 | Stracke |
| 5,293,551 | A | 3/1994 | Perkins et al. |
| 5,299,640 | A | 4/1994 | Streich et al. |
| 5,310,012 | A | 5/1994 | Cendre et al. |
| 5,358,035 | A | 10/1994 | Grudzinski |
| 5,409,031 | A | 4/1995 | McGill et al. |
| 5,440,183 | A | 8/1995 | Denne |
| 5,465,786 | A | 11/1995 | Akkerman |
| 5,558,153 | A | 9/1996 | Holcombe et al. |
| 5,620,048 | A | 4/1997 | Beauquin |
| 5,734,209 | A | 3/1998 | Hallidy |
| 5,913,337 | A | 6/1999 | Williams et al. |
| 5,917,774 | A | 6/1999 | Walkow et al. |
| 6,016,845 | A | 1/2000 | Quigley et al. |
| 6,041,857 | A | 3/2000 | Carmody et al. |
| 6,112,809 | A | 9/2000 | Angle |
| 6,161,722 | A | 12/2000 | Sooudi et al. |
| 6,237,693 | B1 | 5/2001 | Deaton |
| 6,253,843 | B1 | 7/2001 | Rawson et al. |
| 6,302,210 | B1 | 10/2001 | Crow et al. |
| 6,321,845 | B1 | 11/2001 | Deaton |
| 6,352,118 | B1 | 3/2002 | Dickson et al. |
| 6,361,299 | B1 | 3/2002 | Quigley et al. |
| 6,364,023 | B1 | 4/2002 | Hiron et al. |
| 6,427,778 | B1 | 8/2002 | Beall et al. |
| 6,433,991 | B1 | 8/2002 | Deaton et al. |
| 6,478,090 | B2 | 11/2002 | Deaton |
| 6,491,106 | B1 | 12/2002 | Simonds |
| 6,568,470 | B2 | 5/2003 | Goodson et al. |
| 6,619,388 | B2 | 9/2003 | Dietz et al. |
| 6,626,244 | B2 | 9/2003 | Powers |
| 6,700,264 | B2 | 3/2004 | Chu |
| 6,748,977 | B2 | 6/2004 | Berto |
| 6,863,124 | B2 | 3/2005 | Araux et al. |
| 6,988,556 | B2 | 1/2006 | Vick |
| 2002/0023759 | A1 | 2/2002 | Deaton |
| 2002/0108747 | A1 | 8/2002 | Dietz et al. |
| 2002/0112861 | A1 | 8/2002 | Restarick et al. |
| 2003/0019622 | A1 | 1/2003 | Goodson et al. |
| 2003/0155131 | A1 | 8/2003 | Vick, Jr. |

FOREIGN PATENT DOCUMENTS

| | | |
|---|---|---|
| GB | 2200775 | 8/1988 |
| JP | 11093883 | 4/1999 |

* cited by examiner

ELECTRICALLY OPERATED WELL TOOLS

BACKGROUND

The present invention relates generally to equipment utilized and operations performed in conjunction with a subterranean well and, in an embodiment described herein, more particularly provides electrically operated well tools.

Actuators for downhole well tools are typically either hydraulically or electrically operated. Hydraulic actuators have certain disadvantages, for example, the need to run long control lines from the surface to the actuator, problems associated with maintaining a sealed hydraulic circuit, increased resistance to flow through the hydraulic circuit with increased depth, etc.

Electric actuators also have disadvantages. Some of these disadvantages are associated with the fact that typical electric actuators are either powered "on" or "off." For example, in the case of solenoid-type electric actuators, the actuator is in one state or position when current is applied to the actuator, and the actuator is in another state or position when current is not applied to the actuator. This provides only a minimal degree of control over operation of the well tool.

Therefore, it may be seen that improvements are needed in the art of actuating well tools.

SUMMARY

In carrying out the principles of the present invention, a well system is provided in which at least one problem in the art is solved. One example is described below in which an actuator for a well tool provides enhanced control over operation of the well tool. Another example is described below in which the actuator is uniquely constructed for use in a wellbore environment.

In one aspect of the invention, a well system is provided which includes a well tool positioned in a wellbore. The well tool includes an operating member which is displaceable to operate the well tool.

An actuator of the well tool includes a series of longitudinally distributed electromagnets. Current in the electromagnets is controllable in one or more predetermined patterns to thereby variably control longitudinal displacement of the operating member.

In another aspect of the invention, a well system is provided which includes a well tool positioned in a wellbore, the well tool having an operating member and a housing assembly. The operating member is displaceable relative to the housing assembly between opposite maximum limits of displacement.

An actuator of the well tool includes at least one electromagnet. The electromagnet is operative to displace the operating member to at least one position between the opposite maximum limits of displacement.

In yet another aspect of the invention, a method of operating a well tool in a subterranean well is provided. The method includes the steps of: positioning the well tool within a wellbore of the well, the well tool including an operating member and an actuator for displacing the operating member to operate the well tool; and operating the well tool by controlling current in a series of longitudinally distributed electromagnets of the actuator in a predetermined pattern, thereby causing corresponding longitudinal displacement of the operating member.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
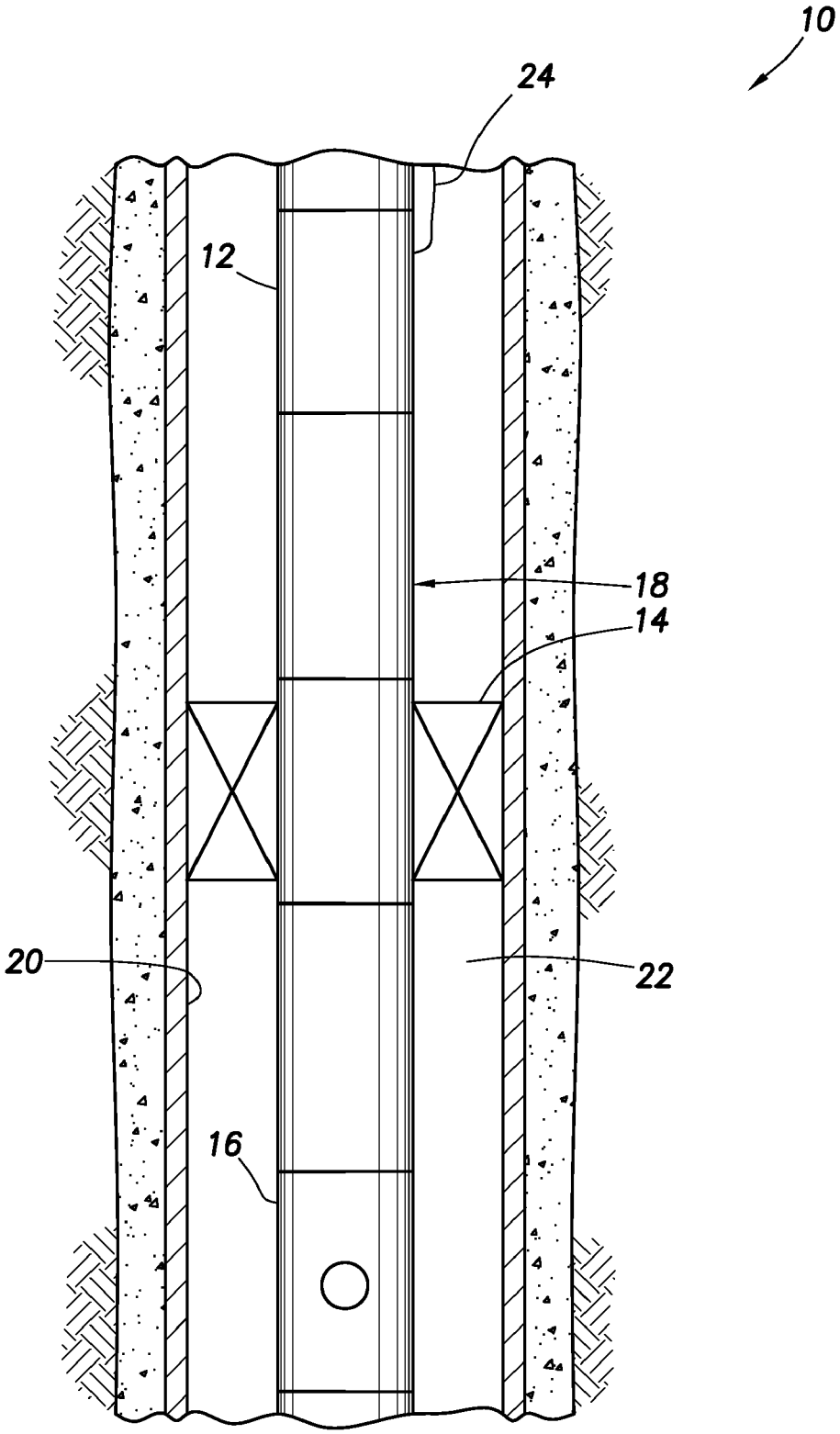
FIG. 1 is a schematic partially cross-sectional view of a well system embodying principles of the present invention.

Representatively illustrated in FIG. 1 is a well system 10 which embodies principles of the present invention. The well system 10 includes several well tools 12, 14, 16 interconnected in a tubular string 18 and positioned downhole in a wellbore 20 of a well. The wellbore 20 is depicted as being cased, but it could alternatively be uncased.

The well tool 12 is depicted as a safety valve for selectively permitting and preventing flow through an internal flow passage of the tubular string 18. The well tool 14 is depicted as a packer for forming an annular pressure barrier in a annulus 22 between the tubular string 18 and the wellbore 20. The well tool 16 is depicted as a flow control device (such as a production, testing or circulating valve, or a choke, etc.) for regulating flow between the annulus 22 and the interior flow passage of the tubular string 18.

It should be clearly understood that the well system 10 is described herein as only one application in which the principles of the invention are useful. Many other well systems, other types of well tools, etc. can incorporate the principles of the invention, and so it will be appreciated that these principles are not limited to any of the details of the well system 10 and well tools 12, 14, 16 described herein.

One or more lines 24 are connected to the well tool 12 and extend to a remote location, such as the surface or another remote location in the well. In this example of the well system 10, the lines 24 are electrical conductors and are used at least in part to supply electrical signals to an actuator of the well tool 12 in order to control operation of the well tool. Alternatively, electrical signals could be supplied by means of other types of lines (such as optical conductors, whereby optical energy is converted into electrical energy in the well tool actuator), or by means of downhole batteries or downhole electrical power generation, etc. Thus, the lines 24 are not necessary in keeping with the principles of the invention.

Figure 2A:
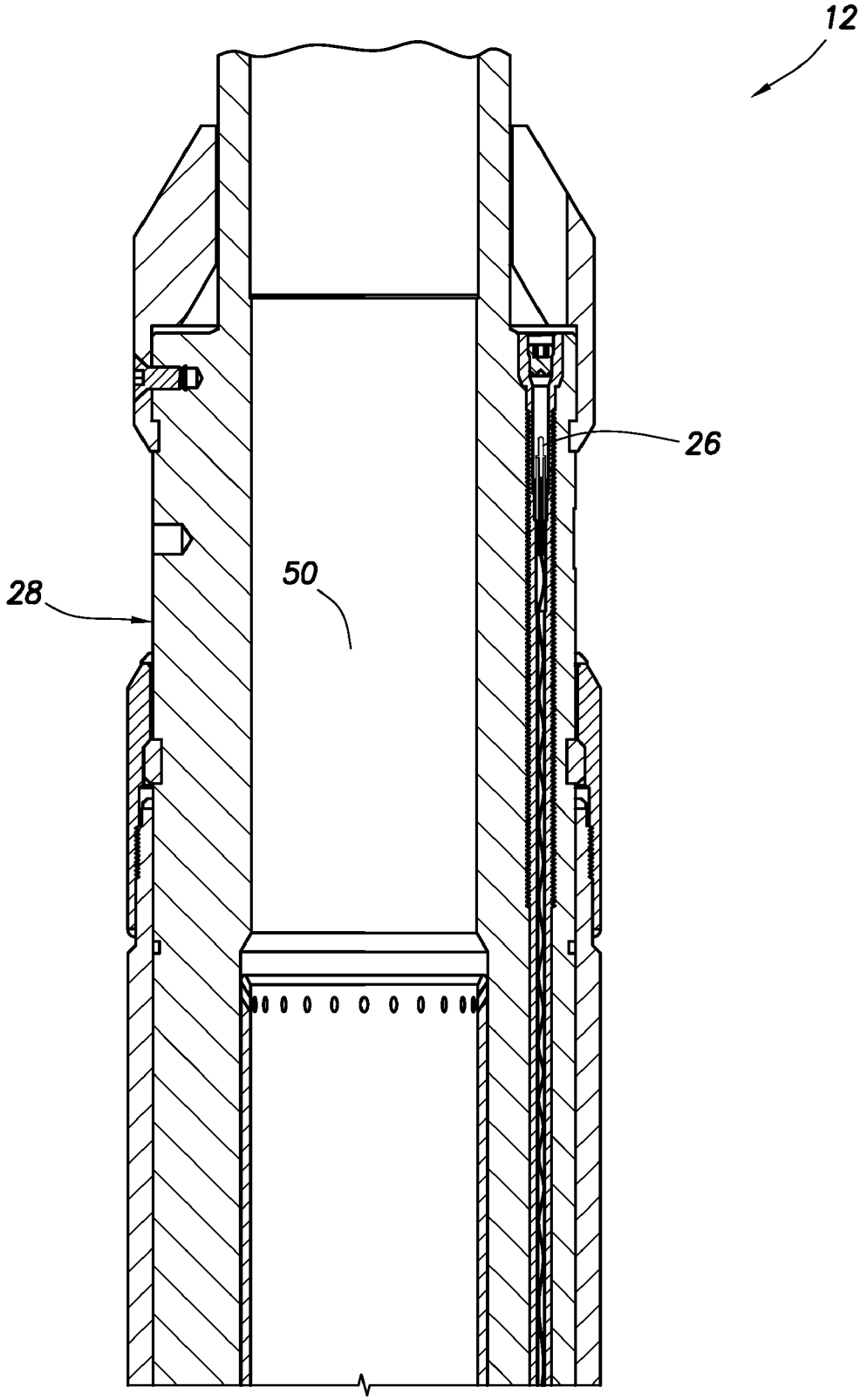
FIGS. 2A-D are enlarged scale cross-sectional views of successive axial sections of a well tool for use in the well system of FIG. 1.
Figure 2B:
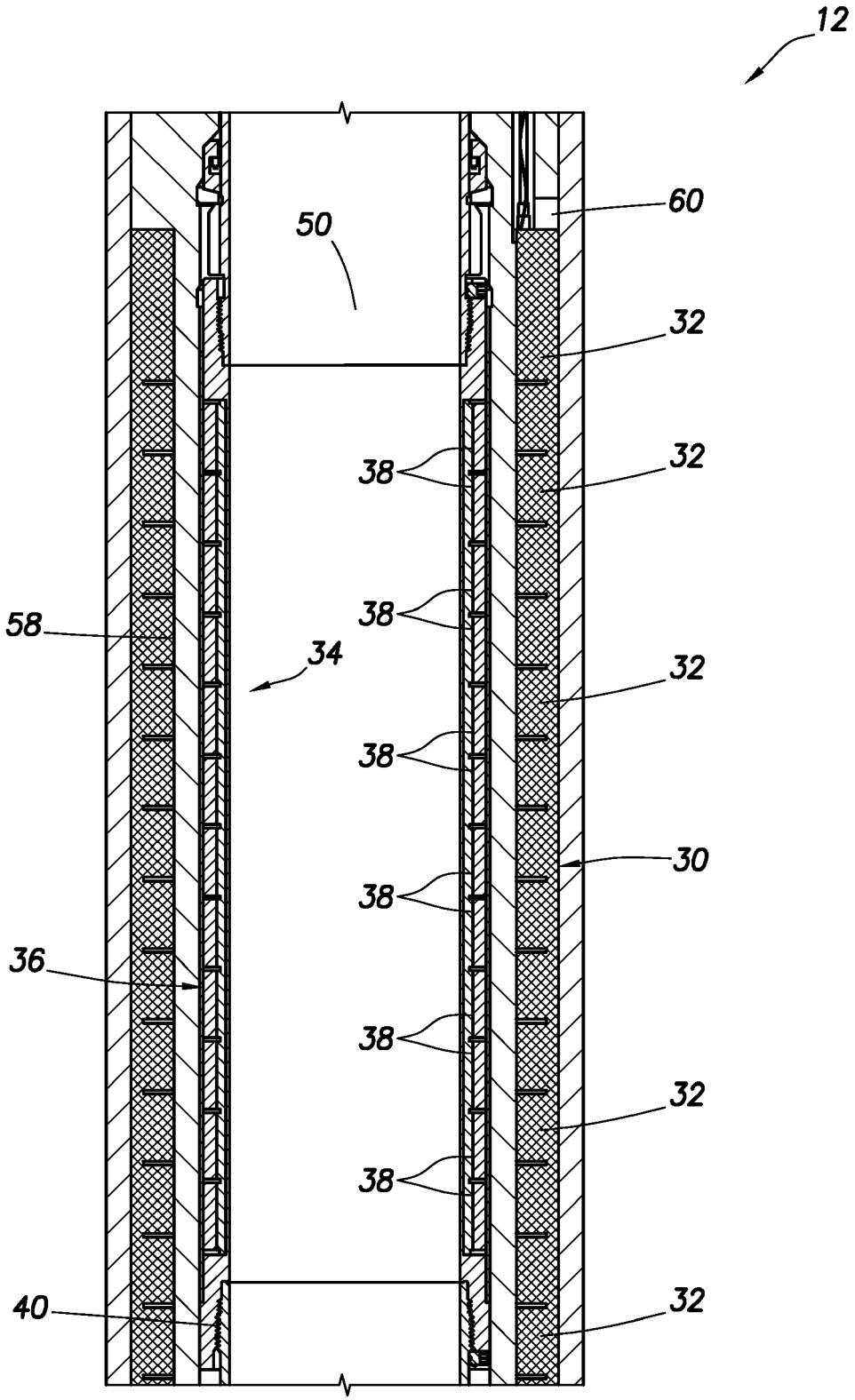
Figure 2C:
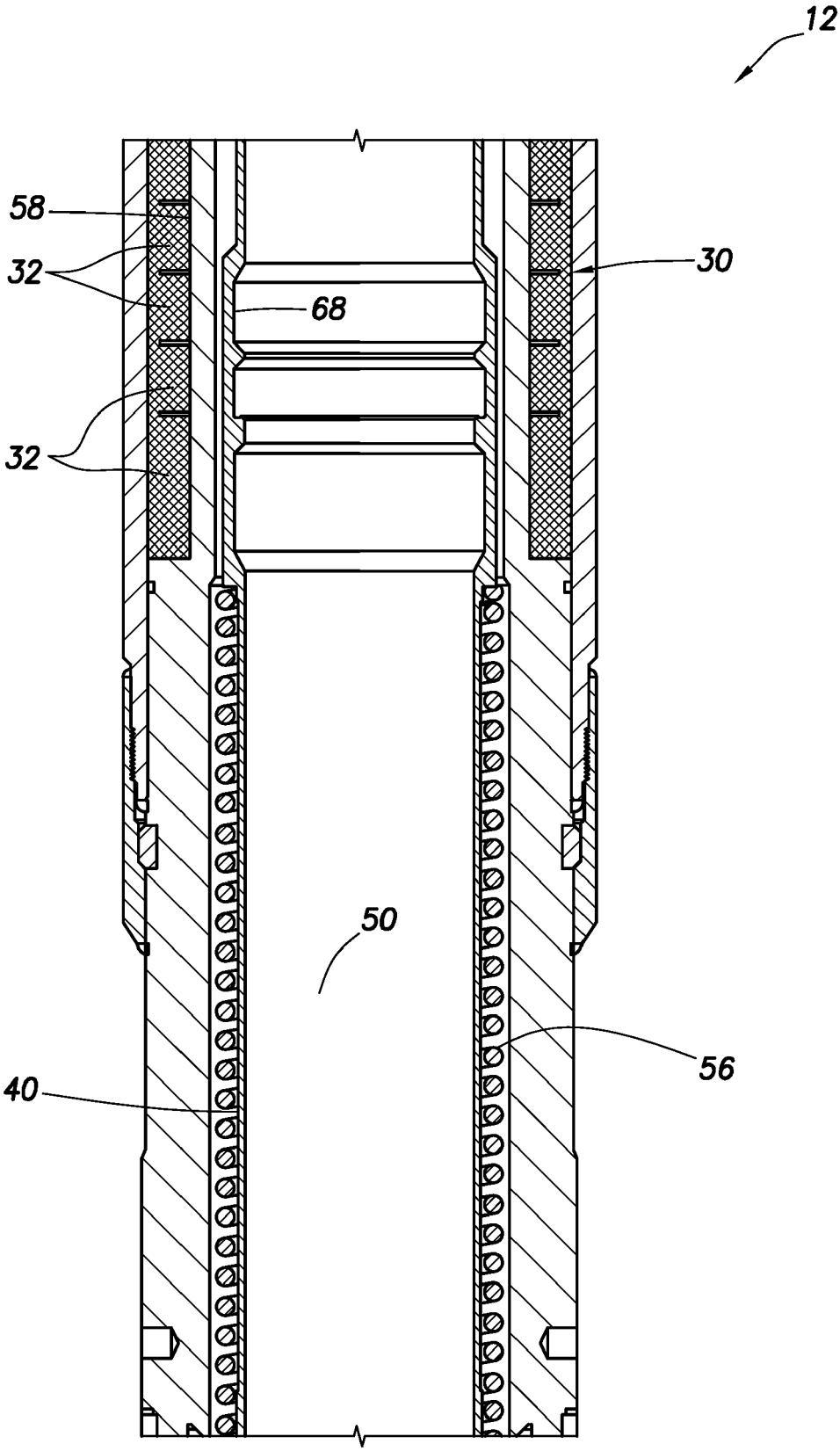

Referring additionally now to FIGS. 2A-D, an enlarged scale detailed cross-sectional view of the well tool 12 is representatively illustrated. In FIG. 2A, it may be seen that electrical connectors 26 (only one of which is visible) are provided in a housing assembly 28 of the safety valve for connecting to the lines 24. In this manner, the lines 24 are electrically coupled to an electromagnet assembly 30 in the housing assembly 28.

The electromagnet assembly 30 includes a series of longitudinally distributed electromagnets 32. The electromagnets 32 are depicted in FIGS. 2A-3D as being in the form of annular coils, but any other type of electromagnets may be used in keeping with the principles of the invention.

In an important feature of the well tool 12, current the electromagnets 32 can be individually controlled via the lines 24. That is, current in any of the individual electromagnets 32, and any combination of the electromagnets, can be controlled in any of multiple predetermined patterns in order to provide enhanced control over operation of the well tool 12.

The electromagnet assembly 30 is a part of an actuator 34 of the well tool 12. Another part of the actuator 34 is a magnet assembly 36. The magnet assembly 36 includes a series of longitudinally distributed annular permanent magnets 38.

The magnet assembly 36 is connected to an operating member 40 of the well tool 12. The operating member 40 is depicted as a flow tube or opening prong of the safety valve. Displacement of the operating member 40 by the actuator 34 is used to operate the well tool 12, for example, by opening and closing a closure assembly 42 of the safety valve.

However, any other types of operating members could be used in keeping with the principles of the invention. For example, if the well tool is a packer (such as the well tool 14), then the operating member could be a setting mandrel or other actuating device of the packer. If the well tool is a flow control device (such as the well tool 16), then the operating member could be a closure member, a flow choking member or other actuating member of the flow control device.

As depicted in FIGS. 2A-D, the operating member 40 is at its maximum upper limit of displacement. The closure assembly 42 is closed when the operating member 40 is in this position. In FIGS. 3A-D, the well tool 12 is depicted with the operating member 40 at its maximum lower limit of displacement. The closure assembly 42 is open when the operating member 40 is in this position.

Figure 2D:
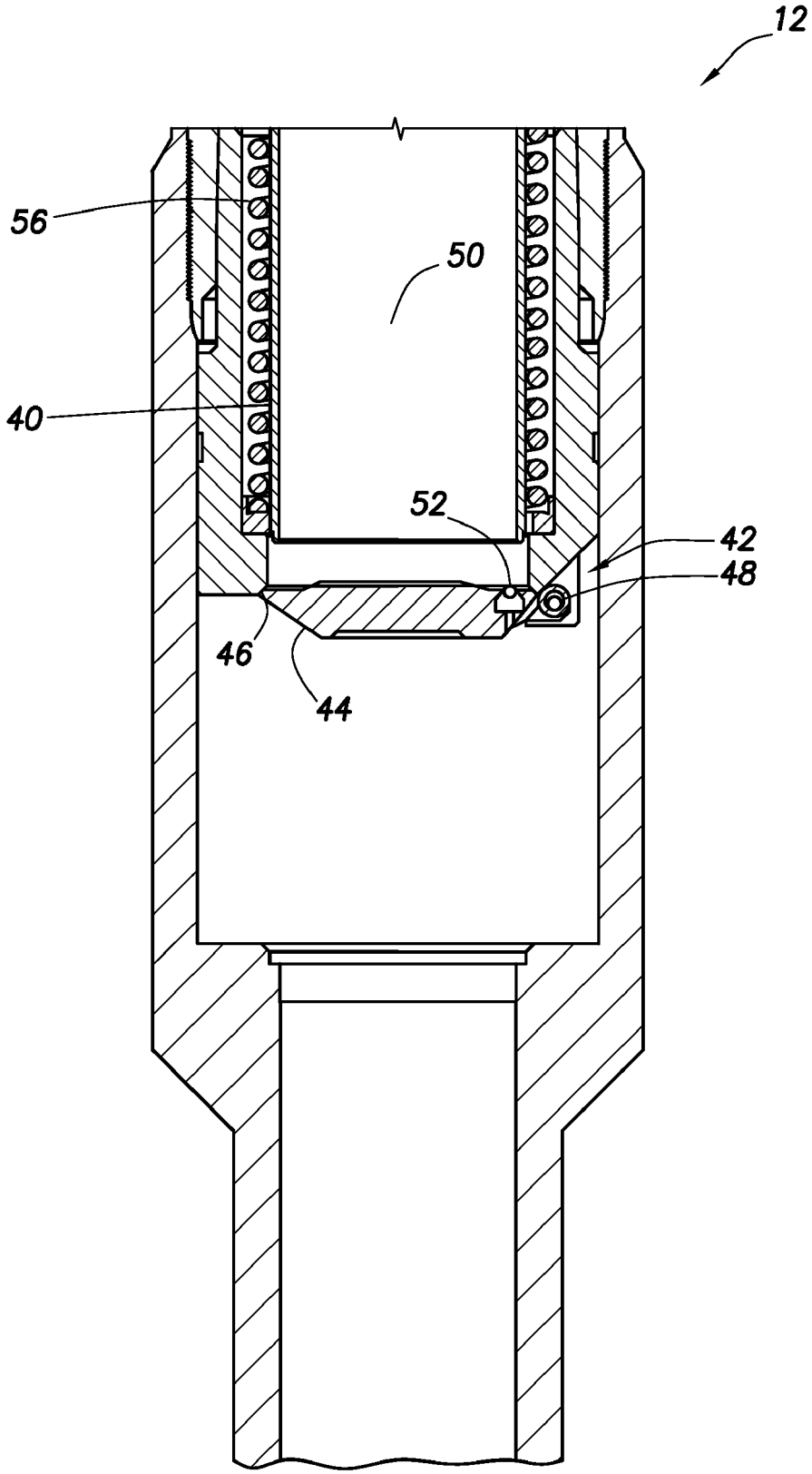
Figure 3A:
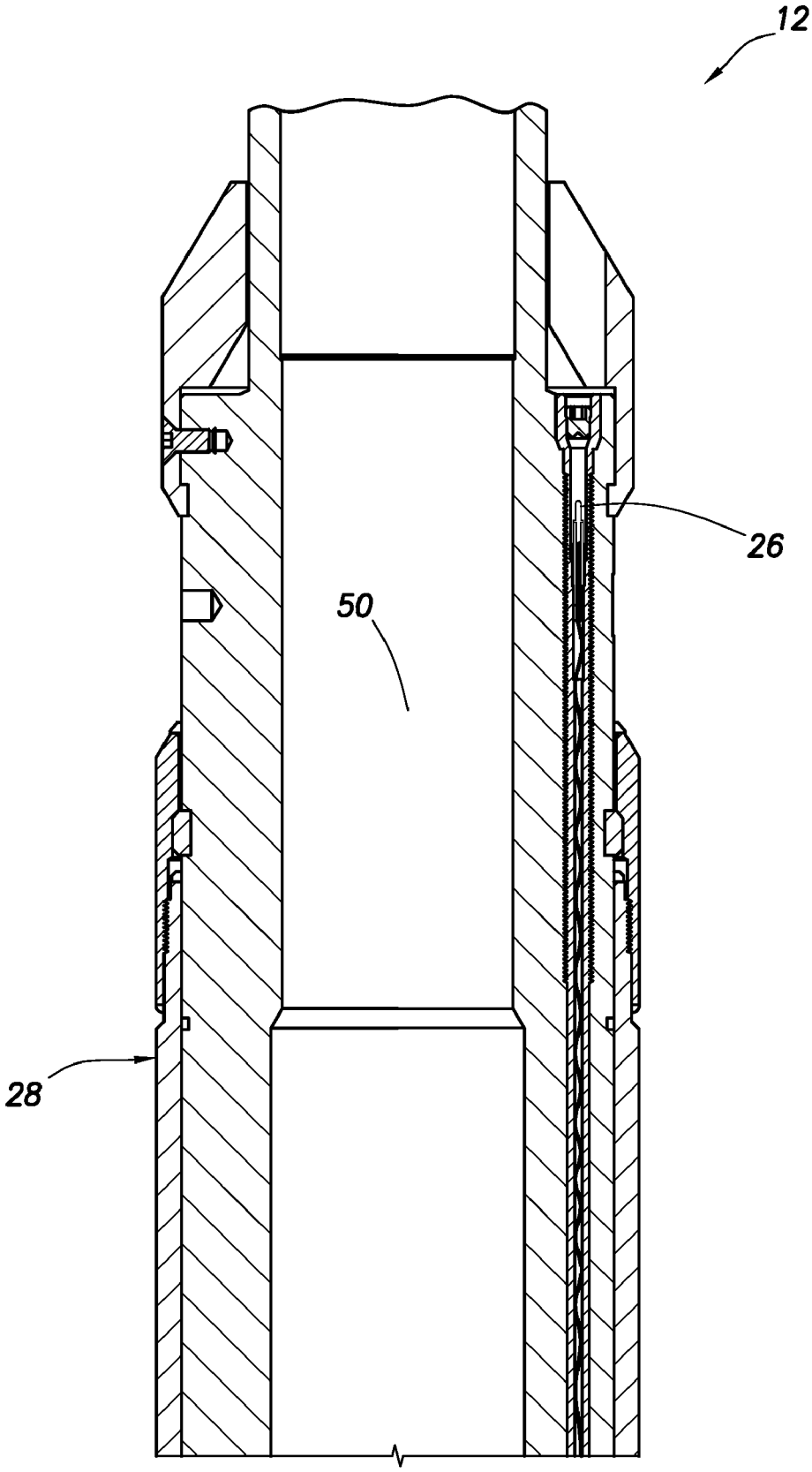
FIGS. 3A-D are cross-sectional views of successive axial sections of the well tool, in which an actuator of the well tool has been used to operate the well tool.
Figure 3B:
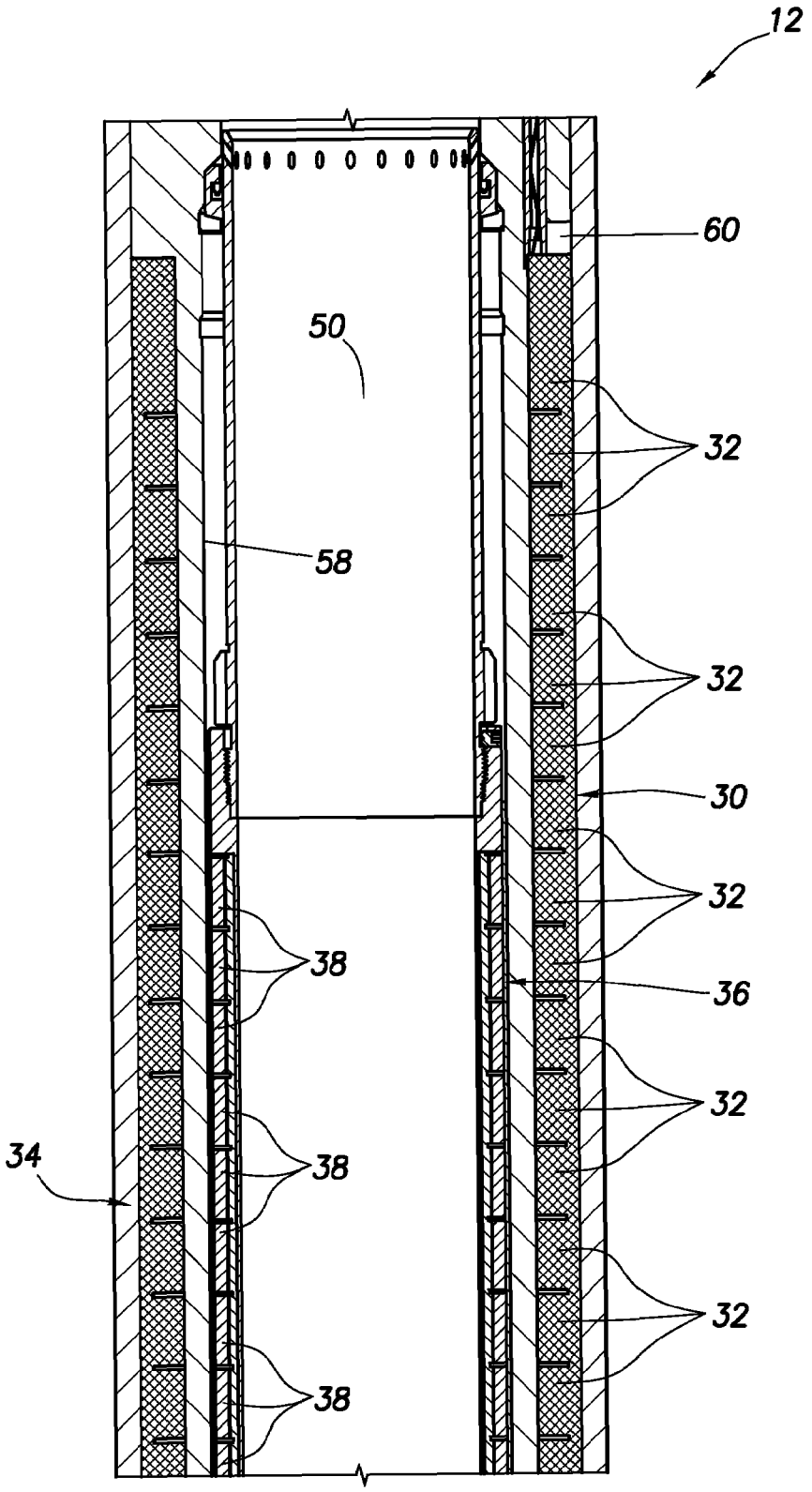
Figure 3C:
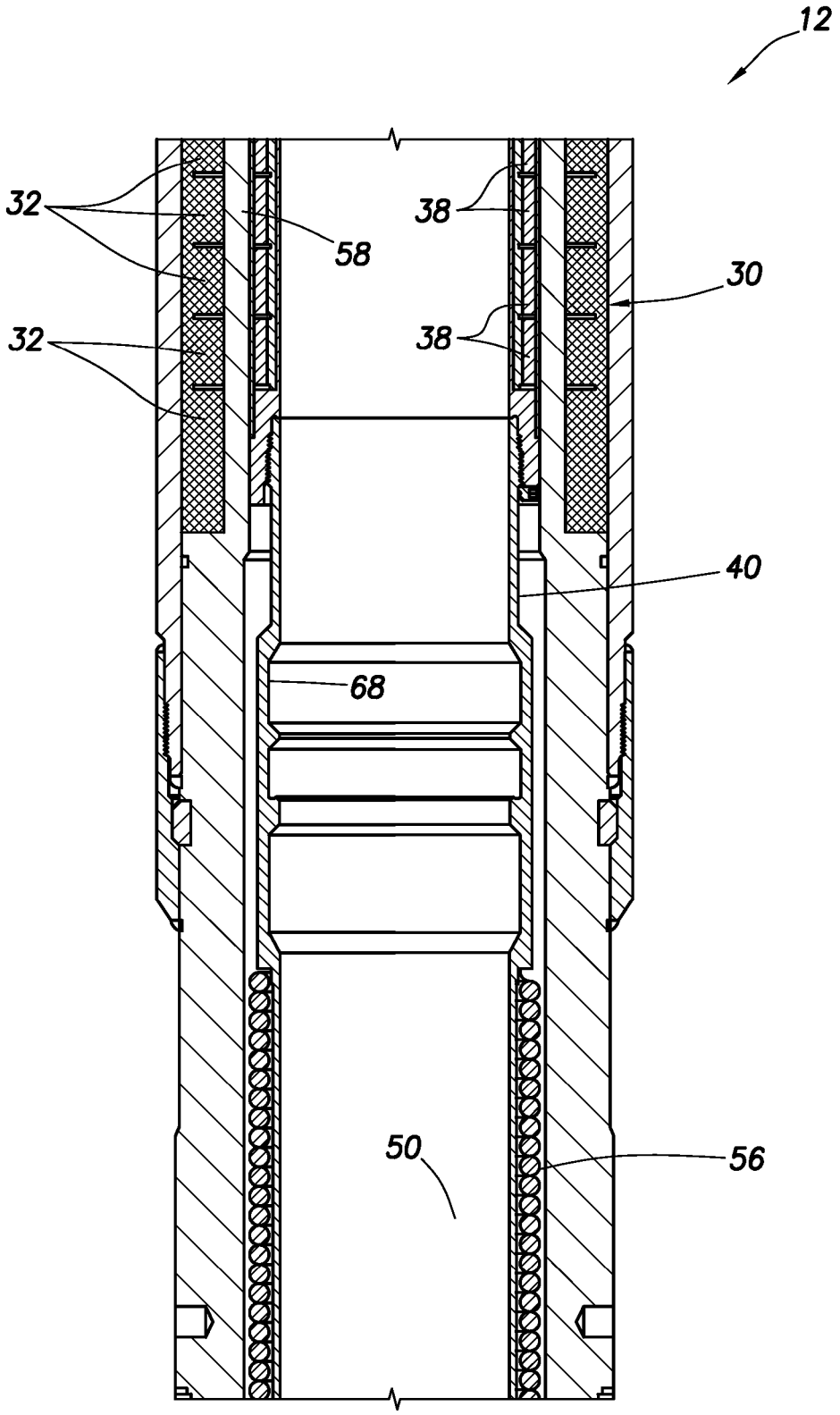
Figure 3D:
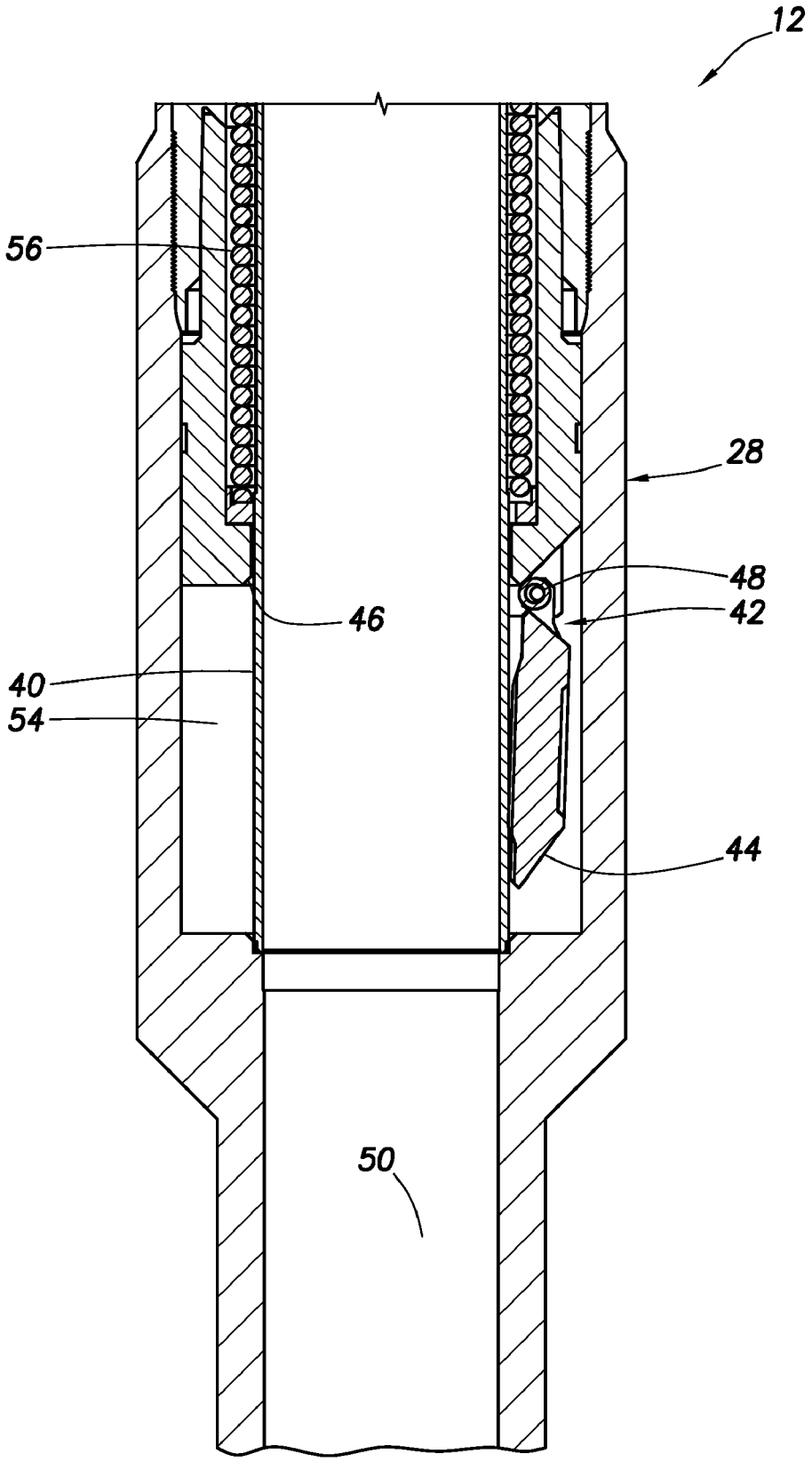

The closure assembly 42 as illustrated in FIGS. 2D & 3D includes a closure member 44, a pivot 48 and a seat 46. When the closure member 44 sealingly engages the seat 46 (as depicted in FIG. 2D), flow through a flow passage 50 of the safety valve is prevented. When the closure member 44 is pivoted away from the seat 46 (as depicted in FIG. 3D), flow through the passage is permitted. With the safety valve interconnected in the tubular string 18 as shown in FIG. 1, the passage 50 forms a part of the internal flow passage of the tubular string.

Although the closure member 44 is depicted in the drawings in the form of a flapper, it should be understood that any type of closure member could be used in any type of closure assembly in keeping with the principles of the invention. For example, a ball valve or sleeve valve could be used instead of a flapper valve, if desired.

In conventional safety valves, an actuator is typically operated merely to alternately position a flow tube or opening prong at its opposite two maximum displacement limits. That is, pressure or electrical current is applied to displace the flow tube or opening prong in one direction to open the safety valve, and the pressure or current is released or discontinued to displace the flow tube or opening prong in an opposite direction to close the safety valve. Thus, the pressure or current is "on" or "off" to correspondingly open or close the safety valve.

In contrast, the actuator 34 is uniquely constructed to permit a wide variety of different types of displacements of the operating member 40. In particular, the electromagnets 32 and magnets 38 are arranged so that displacement of the operating member 40 relative to the housing assembly 28 and closure assembly 42 can be controlled in multiple different ways.

For example, the magnets 38 can be radially polarized, and the polarizations of the individual magnets can be arranged in a specific pattern. Accordingly, current can be controlled in the individual electromagnets 32 in a corresponding pattern to thereby produce a corresponding radially polarized pattern of magnetic fields. Due to the magnetic field patterns produced by the magnets 38 and the electromagnets 32, the operating member 40 can be biased to displace in either longitudinal direction, to remain motionless in any desired position (including any position between its maximum limits of displacement), to vibrate back and forth at any desired position, to accelerate as desired, and to decelerate as desired.

The benefits of these features of the actuator 34 are virtually unlimited. Several examples of the many benefits afforded by the actuator 34 are set forth below, but it should be clearly understood that this is a necessarily incomplete listing, and the invention is not limited in any way to the benefits discussed below.

The actuator 34 can displace the operating member 40 downward from its upper maximum limit of displacement depicted in FIGS. 2A-D, until the operating member 40 engages and opens an equalizing valve 52. The operating member 40 can remain in this position until pressure across the closure assembly 42 is equalized, and then the operating member 40 can be displaced further downward to open the closure assembly. In this manner, excessive stress on the closure assembly 42 and the lower end of the operating member 40 due to attempting to open the closure assembly against a pressure differential can be avoided.

The actuator 34 can periodically displace the operating member 40 upward somewhat from its lower maximum limit of displacement depicted in FIGS. 3A-D, without displacing the operating member upward far enough to allow the closure member 44 to pivot upward and close the closure assembly 42. In this manner, an annular chamber 54 in which the closure member 44, pivot 48 and seat 46 are disposed can be periodically exposed to the flow passage 50, thereby allowing any accumulated sand or other debris to be flushed out of the chamber. The actuator 34 can also vibrate the operating member 40 up and down while it is in this position, so that the debris may be dislodged and more readily flushed out of the chamber 54. Note that this type of maintenance operation may be performed as often as desired, and without requiring the safety valve to be closed and subsequently reopened (which would interrupt production through the tubular string 18).

The actuator 34 can rapidly accelerate the operating member 40 upward from its lower maximum limit of displacement depicted in FIGS. 3A-D, so that the operating member no longer holds the closure member 44 open, in a so-called "slam closure" of the safety valve. In this manner, the stress caused by the lower end of the operating member 40 supporting the closure member 44 while the closure member partially obstructs the flow passage 50 (which stress is particularly severe in high gas flow rate situations) can be minimized.

The actuator 34 can rapidly decelerate the opening member 40 as it approaches its upper or lower maximum limit of displacement. In this manner, the mechanical shock which would otherwise be produced when the operating member 40 abruptly contacts the housing assembly 28 or other portion of the well tool 12 can be minimized or even eliminated. This "braking" function of the actuator 34 may be particularly useful in the situation described above in which the operating member 40 is initially rapidly accelerated to minimize stresses in a "slam closure." Thus, the actuator 34 may be used to produce an initial rapid acceleration of the operating member 40, followed by a rapid deceleration of the operating member.

Preferably, less current is required in the electromagnet assembly 30 to maintain the operating member 40 in a certain position (for example, in an open configuration of the safety valve when the operating member is at its lower maximum limit of displacement) than is required to accelerate, decelerate or otherwise displace the operating member. In this manner, less electrical power is required during long term use of the actuator 34.

The actuator 34 can also be used as a position sensor. For example, depending on the position of the magnet assembly 36 relative to the electromagnet assembly 30, the electromagnets 32 will have correspondingly different resistance to flow of current therethrough. Thus, current flow through the electromagnets 32 is a function of the position of the magnets 38 relative to the electromagnets. This function will change depending on the specific construction, dimensions, etc. of the well tool 12, but the function can be readily determined, at least empirically, once a specific embodiment is constructed. By evaluating the electrical properties of the electromagnets 32 and using the function, the position of the magnets 38 (and thus the operating member 40) relative to the electromagnets can be determined.

The actuator 34 can be used to "exercise" the safety valve as part of routine maintenance. Thus, the operating member 40 can be displaced upward and downward as needed to verify the functionality of the safety valve and to maintain a satisfactory operating condition by preventing moving elements from becoming "frozen" in place due to corrosion, mineral or paraffin deposits, etc.

The actuator 34 can be used to positively bias the operating member 40 to a closed position (e.g., its upper maximum limit of displacement). Typical conventional safety valves rely on a biasing device (such as a spring or compressed gas) to close the valve in the event that applied hydraulic pressure or electrical power is lost (e.g., either intentionally or due to an accident or emergency situation). In contrast, current applied to the electromagnet assembly 30 in a certain pattern can be used to bias the operating member 40 upward, and current applied to the electromagnet assembly in another pattern can be used to bias the operating member downward. Thus, the safety valve of FIGS. 2A-3D can be "powered" open and closed.

These features of the actuator 34 are similarly useful in other types of well tools. For example, in the well tool 14 the actuator 34 could be used to set and unset the packer. In the well tool 16, the actuator 34 could be used to increase and decrease flow rate through the valve or choke.

Of course, the well tool 12 can include a biasing device 56 (depicted in FIGS. 2A-3D as a compression spring) to bias the operating member 40 toward its upper maximum limit of displacement, so that in the event that the actuator 34 cannot be used to operate the well tool 12, the operating member will displace upward and the closure assembly 42 will close. In addition, the well tool 12 can include features, such as an internal latching profile 68 formed on the operating member 40, to allow the safety valve to be operated or "locked out" without use of the actuator 34.

An example of a linear actuator which utilizes annular magnet and electromagnet assemblies is described in U.S. Pat. No. 5,440,183. The entire disclosure of this patent is incorporated herein by this reference. The annular magnet and electromagnet assemblies described in the incorporated patent may be used in the actuator 34, if desired. However, it should be clearly understood that other types of magnet and electromagnet assemblies may be used in keeping with the principles of the invention.

Although the electromagnet assembly 30 is depicted in FIGS. 2A-3D as being external to the magnet assembly 36, this relative positioning could be reversed, if desired. That is, the assembly 36 could be an electromagnet assembly and the assembly 30 could be a magnet assembly in this embodiment of the well tool 12.

Furthermore, the magnet assembly 36 does not necessarily include permanent magnets, but could instead include electromagnets (such as the electromagnets 32 in the electromagnet assembly 30). Thus, instead of using the electromagnets 32 and the permanent magnets 38, the actuator 34 could use two sets of electromagnets, with one set of electromagnets being secured to the housing assembly 28, and with the other set of electromagnets being attached to the operating member 40.

A pressure bearing rigid annular wall 58 is depicted in FIGS. 2A-3D as isolating the electromagnet assembly 30 from fluid and pressure in the flow passage 50. In this manner, the electromagnet assembly 30 is disposed in an isolated chamber 60 (preferably at atmospheric pressure) which may also accommodate electronic circuitry, for example, for applying the predetermined patterns of current to the individual electromagnets 32, controlling the current in particular electromagnets to produce the patterns, evaluating electrical properties of the electromagnets to perform the position sensing function, etc.

Current in particular electromagnets 32 may be controlled in various manners to thereby control displacement of the operating member 40. For example, the current in the electromagnets 32 could be switched on and off in predetermined patterns, the current direction or polarity could be varied, the voltage could be varied, the current amplitude could be varied, the current could be manipulated in other manners, etc. Thus, it should be understood that current in the electromagnets may be controlled in any way, and in any pattern, in keeping with the principles of the invention.

Note that it is not necessary for the electromagnet assembly 30 to be isolated from the fluid pressure in the passage 50. For example, the wall 58 could be thin enough, or could be made of a suitable material, so that pressure is transmitted from the passage 50 to the assembly 30. As another example, the electromagnets 32 could be "potted" or otherwise provided with an insulating layer, so that it is not necessary to isolate the electromagnets from the passage 50 with a rigid wall. Thus, it will be appreciated that the specific construction details of the well tool 12 depicted in the drawings and described herein are merely examples of ways in which the invention may be practiced in these embodiments.

A person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A well system, comprising:

a well tool positioned in a wellbore, the well tool including an operating member which is displaceable to operate the well tool; and an actuator of the well tool including a series of longitudinally distributed electromagnets, and current in each of the electromagnets being separately controllable in at least one predetermined pattern to thereby variably control longitudinal displacement of the operating member.

2. The well system of claim 1, wherein the electromagnets are externally positioned relative to at least one permanent magnet connected to the operating member.

3. The well system of claim 1, wherein at least one permanent magnet connected to the operating member is externally positioned relative to the electromagnets.

4. The well system of claim 1, wherein the current in the electromagnets is controllable to position the operating member between opposite maximum limits of displacement.

5. The well system of claim 1, wherein the well tool is a safety valve which selectively permits and prevents flow through a tubular string in the well, and wherein displacement of the operating member operates a closure assembly of the safety valve.

6. A well system, comprising:

a well tool positioned in a wellbore, the well tool including an operating member which is displaceable to operate the well tool; and an actuator of the well tool including a series of longitudinally distributed electromagnets, and current in the electromagnets being controllable in at least one predetermined pattern to thereby variably control longitudinal displacement of the operating member, wherein the current in the electromagnets is controllable to variably accelerate the operating member.

7. A well system, comprising:

a well tool positioned in a wellbore, the well tool including an operating member which is displaceable to operate the well tool; and an actuator of the well tool including a series of longitudinally distributed electromagnets, and current in the electromagnets being controllable in at least one predetermined pattern to thereby variably control longitudinal displacement of the operating member, wherein the current in the electromagnets is controllable to variably decelerate the operating member.

8. A well system, comprising:

a well tool positioned in a wellbore, the well tool including an operating member displaceable between opposite maximum limits of displacement to operate the well tool; and an actuator of the well tool including at least one electromagnet, and wherein the electromagnet is operative to fixedly position the operating member in at least one position between the opposite maximum limits of displacement.

9. The well system of claim 8, wherein the actuator includes a longitudinally distributed series of the electromagnets, and wherein current in the electromagnets is controllable in a predetermined pattern to thereby variably control longitudinal displacement of the operating member.

10. The well system of claim 8, wherein the electromagnet is isolated from fluid pressure within an internal flow passage of the well tool.

11. The well system of claim 8, wherein the well tool is a safety valve, and wherein at one of the maximum limits of displacement of the operating member the safety valve is open, and at the other of the maximum limits of displacement of the operating member the safety valve is closed.

12. A well system, comprising:

a well tool positioned in a wellbore, the well tool including an operating member displaceable between opposite maximum limits of displacement to operate the well tool; and an actuator of the well tool including at least one electromagnet, and wherein the electromagnet is operative to displace the operating member to at least one stationary position between the opposite maximum limits of displacement, wherein the electromagnet is exposed to fluid pressure within an internal flow passage of the well tool.

13. A well system, comprising:

a well tool positioned in a wellbore, the well tool including an operating member displaceable between opposite maximum limits of displacement to operate the well tool; and an actuator of the well tool including at least one electromagnet, and wherein the electromagnet is operative to displace the operating member to at least one stationary position between the opposite maximum limits of displacement, wherein current applied to the electromagnet biases the operating member to displace in a first longitudinal direction, and wherein current applied to the electromagnet biases the operating member to displace in a second longitudinal direction opposite to the first longitudinal direction.

14. A method of operating a well tool in a subterranean well, the method comprising the steps of:

positioning the well tool within a wellbore of the well, the well tool including an operating member and an actuator for displacing the operating member to operate the well tool; and operating the well tool by separately controlling current in each of a series of longitudinally distributed electromagnets of the actuator in a predetermined pattern, thereby causing corresponding longitudinal displacement of the operating member.

15. The method of claim 14, wherein in the positioning step, the actuator includes a series of longitudinally distributed permanent magnets.

16. The method of claim 15, wherein the magnets are connected to the operating member.

17. The method of claim 15, wherein the electromagnets are connected to the operating member.

18. The method of claim 14, wherein in the positioning step, the well tool is a safety valve, and wherein the operating step further comprises operating a closure assembly of the safety valve in response to displacement of the operating member.

19. The method of claim 18, wherein the operating step further comprises applying current to the electromagnets to close the closure assembly, and applying current to the electromagnets to open the closure assembly.

20. The method of claim 18, wherein the operating step further comprises controlling the current in the electromagnets to displace the operating member to a position between opposite maximum limits of displacement of the operating member.

21. The method of claim 20, wherein pressure across the closure assembly is equalized when the operating member is at the position between the opposite maximum limits of displacement.

22. The method of claim 14, wherein the operating step further comprises displacing the operating member against a biasing force exerted by a biasing device of the well tool.

23. A method of operating a well tool in a subterranean well, the method comprising the steps of:

positioning the well tool within a wellbore of the well, the well tool including an operating member and an actuator for displacing the operating member to operate the well tool; and operating the well tool by controlling current in a series of longitudinally distributed electromagnets of the actuator in a predetermined pattern, thereby causing corresponding longitudinal displacement of the operating member, and wherein the operating step further comprises controlling the current in the electromagnets to decelerate the operating member.

24. A method of operating a well tool in a subterranean well, the method comprising the steps of:

positioning the well tool within a wellbore of the well, the well tool including an operating member and an actuator for displacing the operating member to operate the well tool; and operating the well tool by controlling current in a series of longitudinally distributed electromagnets of the actuator in a predetermined pattern, thereby causing corresponding longitudinal displacement of the operating member, and wherein the operating step further comprises controlling current in the electromagnets to accelerate and then decelerate the operating member.

25. A method of operating a well tool in a subterranean well, the method comprising the steps of:

positioning the well tool within a wellbore of the well, the well tool including an operating member and an actuator for displacing the operating member to operate the well tool;

operating the well tool by controlling current in a series of longitudinally distributed electromagnets of the actuator in a predetermined pattern, thereby causing corresponding longitudinal displacement of the operating member; and detecting a position of the operating member by evaluating the position as a function of resistance to current flow in the electromagnets.

* * * * *

UNITED STATES PATENT AND TRADEMARK OFFICE

CERTIFICATE OF CORRECTION

PATENT NO. : 7,640,989 B2
APPLICATION NO. : 11/469269
DATED : January 5, 2010
INVENTOR(S) : Williamson, Jr. et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 305 days.

Signed and Sealed this

Sixteenth Day of November, 2010

David J. Kappos

David J. Kappos
*Director of the United States Patent and Trademark Office*